US005995004A

United States Patent [19]

Pellowski

[11] Patent Number: 5,995,004

[45] Date of Patent: Nov. 30, 1999

[54] COVERT ACTUATION SYSTEM FOR ELECTRIC DEVICE

[76] Inventor: John D. Pellowski, 6397 Red Spruce La., Sykesville, Md. 21784

[21] Appl. No.: 09/065,530

[22] Filed: Apr. 24, 1998

[51] Int. Cl.[6] ..... G08B 13/14

[52] U.S. Cl. ..... 340/570; 340/568.1; 439/40; 439/917

[58] Field of Search ..... 340/568.1, 570; 439/4, 32, 40, 917

[56] References Cited

U.S. PATENT DOCUMENTS

| | | | |
|---|---|---|---|
| 1,494,656 | 5/1924 | Wherland | 340/570 |
| 3,253,083 | 5/1966 | Timbers | 172/52.1 |
| 3,300,572 | 1/1967 | Dahlgren et al. | 174/69 |
| 3,300,770 | 1/1967 | Brousseau et al. . | |
| 3,569,644 | 3/1971 | Brugger et al. | 340/570 |
| 3,618,060 | 11/1971 | Nina | 340/570 |
| 3,643,195 | 2/1972 | Sawyer | 335/285 |
| 3,725,893 | 4/1973 | Malta et al. | 340/570 |
| 3,885,773 | 5/1975 | Dunkelberger . | |
| 4,268,823 | 5/1981 | Rauchut et al. | 340/570 |
| 5,059,949 | 10/1991 | Caparoni et al. | 340/571 |
| 5,416,826 | 5/1995 | Butler | 340/570 |
| 5,440,107 | 8/1995 | Phillips | 340/570 |
| 5,512,877 | 4/1996 | Gels et al. | 340/570 |
| 5,517,177 | 5/1996 | Cantrall . | |

*Primary Examiner*—Glen Swann
*Attorney, Agent, or Firm*—Rosenberg, Klein & Bilker

[57] ABSTRACT

There is provided a covert actuation system (50) adapted for incorporation within a housing structure. The system (50) includes a storage assembly (20) displaceably coupled to a frame assembly (10) for covertly actuating an electric device (30*a*, 30*b*) coupled to the housing structure. Covert actuation system (50) comprises an attachment mechanism (100) coupled to the frame assembly (10); an electric connector mechanism (300) also coupled to the frame assembly (10) adapted for the electrical connection thereto of at least one electric device (30*a*, 30*b*); at least one actuation device (400) coupled to the storage assembly (20); and, a conductor assembly (200) which electrically couples actuation device (400) to electric connector mechanism (300). Conductor assembly (200) includes a flexible intermediate section (210) along which a plurality of adherent devices (220) are disposed in a predetermined spaced manner. Adherent devices (220) are adapted to releasably adhere to attachment member (100) such that intermediate section (210) is retained substantially against attachment member (100) when the storage assembly (20) is displaced to a first position relative to the frame assembly (10), and is progressively drawn away from attachment member (100) responsive to the displacement of the storage assembly (20) toward a second position relative to the frame assembly (10).

20 Claims, 6 Drawing Sheets

COVERT ACTUATION SYSTEM FOR ELECTRIC DEVICE

BACKGROUND OF THE INVENTION

Field of the Invention

The subject covert actuation system is generally directed to a system for covertly actuating an electric device coupled thereto. More specifically, the subject covert actuation system is one which operates in concealed manner to automatically actuate one or more electric devices, such as an alarm or surveillance camera within a security system, upon the occurrence of a triggering condition, and does so in a highly reliable manner.

In applications such as building security systems, the need for reliable automatic actuation of its various alarm and surveillance equipment at the necessary times cannot be overstated. In such applications, a triggering condition invariably arises during the perpetration of a crime when those seeking to actuate the security system equipment are under the threat of immediate and serious bodily harm from those perpetrating the crime. An individual in such a threatening situation cannot realistically be expected to manually actuate the given security system equipment in a discrete enough manner to avoid endangering himself or herself and others, let alone to carry out remedial action should an automatic triggering device fail to function as expected. It is imperative, therefore, that any automatic actuation system in such an application trigger automatically when necessary, and that it do so in covert, yet failsafe, manner.

In known systems, the automatic actuation device is typically concealed within a currency drawer, or other storage compartment, assembly that is displaced relative to a cabinet or other frame structure between an open and a closed position. Hardwired electrical coupling between the actuation device and the electronic equipment outside the frame structure to be actuated is routed, for concealment purposes, from the drawer assembly through the internal spaces of the frame structure.

Thorough concealment of the actuation device is aided in no small measure by the presence in substantial volume of currency, documents, and other such articles amply occupying the drawer assembly which serve to block the actuating mechanism from view. While it is beneficial for concealment purposes, the abundance of articles within the given drawer assembly is hardly beneficial for system reliability purposes. Indeed, the loose contents of the drawer assembly tend to protrude outward into contact with the inner surfaces of the frame structure compartment into which the drawer assembly is received, in many cases escaping from the drawer assembly altogether into the frame structure compartment. The frequently unavoidable result, then, is an encroachment or other physical disturbance of the hardwired conductors leading from the actuation device in the drawer assembly and through the frame structure compartment. Over time, and with repeated withdrawal and return of the drawer assembly, the cumulative effect of the physical disturbance becomes sufficient to invoke failure of the actuation system.

The presence in ample numbers of various loose articles and debris related thereto within the drawer assembly is, in practice, virtually unavoidable and, in fact, necessary for concealment purposes. Consequently, measures must be taken to prevent disruptive contact not only between conductors leading to and from the drawer assembly and immediately surrounding hardware, but also between the conductors and the drawer assembly's loose contents. The conductors and electrical connectors typically employed for internal security system applications are not gauged to endure heavy duty use, nor extreme environmental conditions; therefore, they are quite vulnerable to failure-inducing mechanical disruptions. Conductors and connectors of significantly more durable, heavy duty construction do not provide a practical solution, as the augmented mechanical properties would necessarily be accompanied by diminished flexibility, bulkier volume, and greater weight—all of which tend to interfere with smooth operation of the drawer assembly, and thereby compromise the actuation system's concealability, among other things.

Prior Art

Automatic electronic device actuation systems for such applications as security systems are known in the art. The best prior art known to Applicant includes U.S. Pat. Nos. 5,440,107; 3,643,195; 3,253,083; 3,300,572; 5,059,949; 4,268,823; 5,512,877; 3,725,893; 3,569,644; 3,618,060; 5,517,177; 1,494,656; 5,416,826; 3,885,773; and, 3,300,770. While such known systems disclose various discrete system or hardware component features, they do not disclose the unique combination of features provided by the subject actuation system to enable them, even in combination, to realize the degree of reliability offered by the subject actuation system without compromise of covert operability.

For instance, U.S. Pat. No. 5,440,107 is directed to a money clip alarm system integrated in a money drawer assembly. A money clip is mounted in this system to the floor panel of a drawer tray. A coil cord assembly is employed to connect the electrical conductors routed from the money clip and about the drawer tray to a remote alarm system. Although the coil cord inherently provides the recoiling of the slack in the coil necessary to facilitate withdrawal of the drawer tray, the cord assembly continually remains within the drawer tray's displacement path. The coil cord assembly, therefore, remains subject to disruptive interference by loose articles that have fallen out of the drawer tray or other debris occupying the space around it. The coil cord also remains free to engage the track or other suspension/guide mechanism of the drawer tray during its displacement.

U.S. Pat. No. 3,643,195 is directed to a magnetic takeup device for an umbilical cable, or the like, in a plotter. The flexible umbilical leading to a displaceable plotting head in that device is provided along its entire length with a magnetic band that adheres to a magnetic strip attached to a bracket of the plotter, such that slack in the umbilical is taken up as the plotting head is displaced in a given direction. In obvious contrast to the subject actuation system, there is no provision in this system for an actuation device within a drawer or other displaceable storage assembly to which electrical coupling is to be maintained in concealed manner. The degree of flexibility of the umbilical cable, moreover, is necessarily limited in this system by the flexibility of the magnetic strip applied along its length.

Similarly, U.S. Pat. No. 3,253,083 is directed to a cable retractor for use with an extendable chassis, but it discloses specific features which depart in structure, function, and application from the subject actuation system. The cable retractor system of this reference employs a plurality of elastic members which anchor various points of a cable extending from the back of a displaceable chassis to a surrounding retractor frame. The elastic members expand and contract to cooperatively bias the cable towards the retractor frame. The cable and the elastic members themselves continually remain, at all times, occupying the space within the path of displacement of the chassis. Consequently, they remain quite vulnerable to interfering contact with not only the debris that might also occupy the space, but with the track or other suspension/guide mechanism of the chassis.

There remains a need in the prior art for an electric device actuation system operably integrated with a storage assembly displaceably retained within a frame assembly which enables covert actuation of the electric device in highly reliable manner. There is a need for such a covert system whose reliability is not compromised by operational factors typically encountered in various intended applications.

SUMMARY OF THE INVENTION

A primary object of the present invention is to provide a covert actuation system for covert automatic actuation of at least one electric device coupled thereto which operates with a high degree of reliability.

It is another object of the present invention to provide a covert actuation system which may be operably integrated with a storage assembly displaceably retained within a frame assembly.

It is another object of the present invention to provide a covert actuation system which provides highly reliable actuation of an electric device coupled thereto upon the occurrence of a predetermined triggering event or condition.

It is still another object of the present invention to provide a covert actuation system which very simply and efficiently minimizes the likelihood of disruptive engagement of a conductor mechanism extending between a displaceable storage assembly and a stationary frame assembly by any surrounding hardware components or by surrounding articles or debris.

It is yet another object of the present invention to provide a covert actuation system which may be conveniently and inexpensively incorporated into an existing structural assembly.

These and other objects are attained in the subject covert actuation system adapted for incorporation within a housing structure having a storage assembly displaceably coupled to a frame assembly. The covert actuation system operates automatically in highly reliable covert manner to actuate one or more electric devices coupled to the housing structure.

Accordingly, the subject covert actuation system comprises an attachment member coupled to the frame assembly; an electric connector mechanism also coupled to the frame assembly; at least one actuation device coupled to the storage assembly; a conductor assembly coupled to both the storage assembly and the frame assembly; and, a plurality of adherent devices coupled to the conductor assembly. The actuation device is one which is operable to automatically actuate at least one given electric device upon the occurrence of a triggering event. The conductor assembly which is electrically coupled to this actuation device includes a flexible intermediate section that extends between the storage assembly and the electric connector mechanism; and, it is along this flexible intermediate section that a plurality of adherent devices are coupled in a predetermined spaced manner. The adherent devices are adapted to releasably adhere to a substantially planar attachment surface of the attachment member in such manner that substantially all of the conductor assembly's intermediate section is retained substantially against the attachment surface when the storage assembly is displaced to a first position relative to the frame assembly, then is progressively drawn away from the attachment surface responsive to the displacement of the storage assembly toward a second position relative to the frame assembly.

DESCRIPTION OF THE PREFERRED EMBODIMENTS

Figure 1:
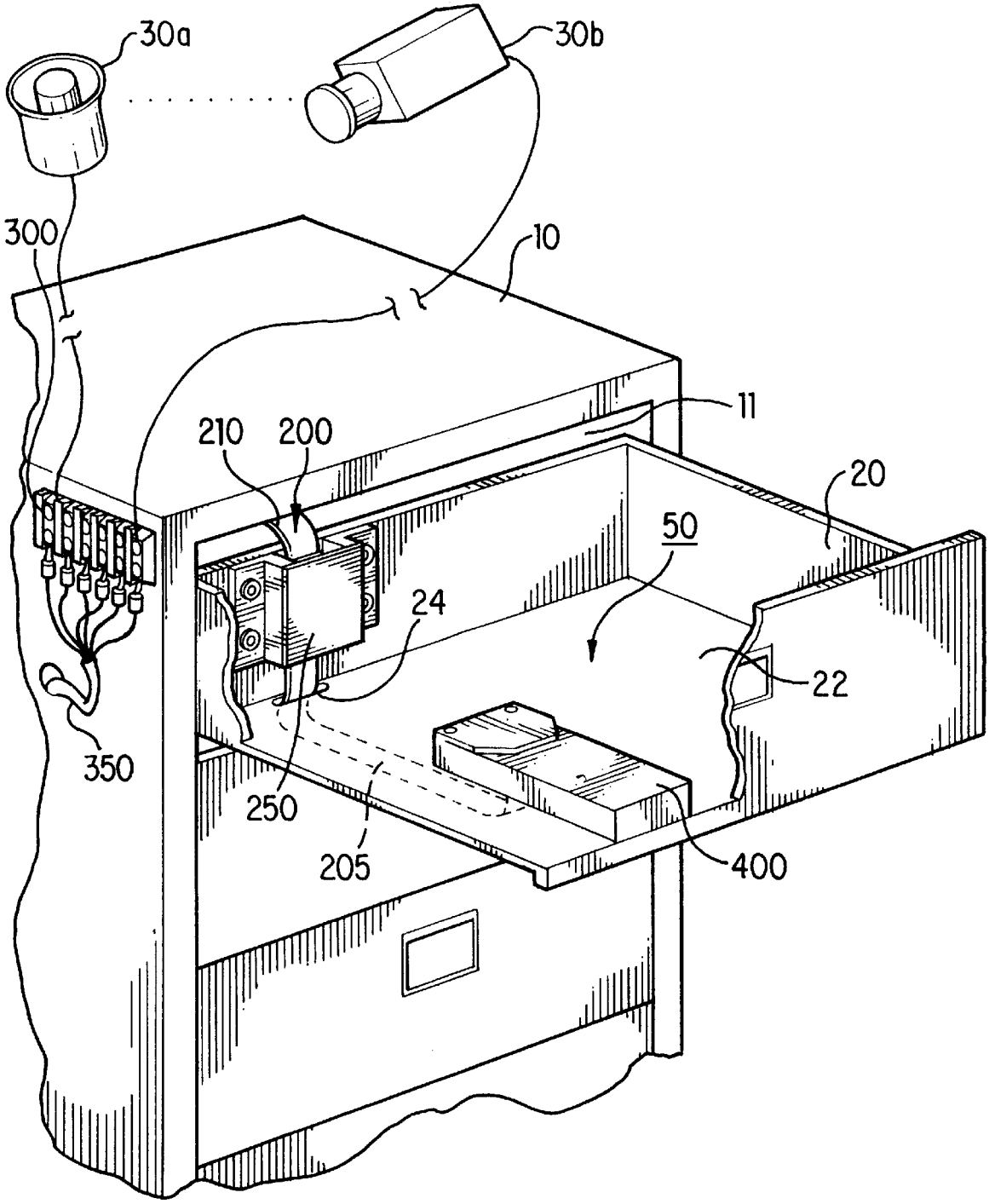
FIG. 1 is a perspective view, partially cut-away, of a preferred embodiment of the present invention shown in an exemplary application.
Figure 2:
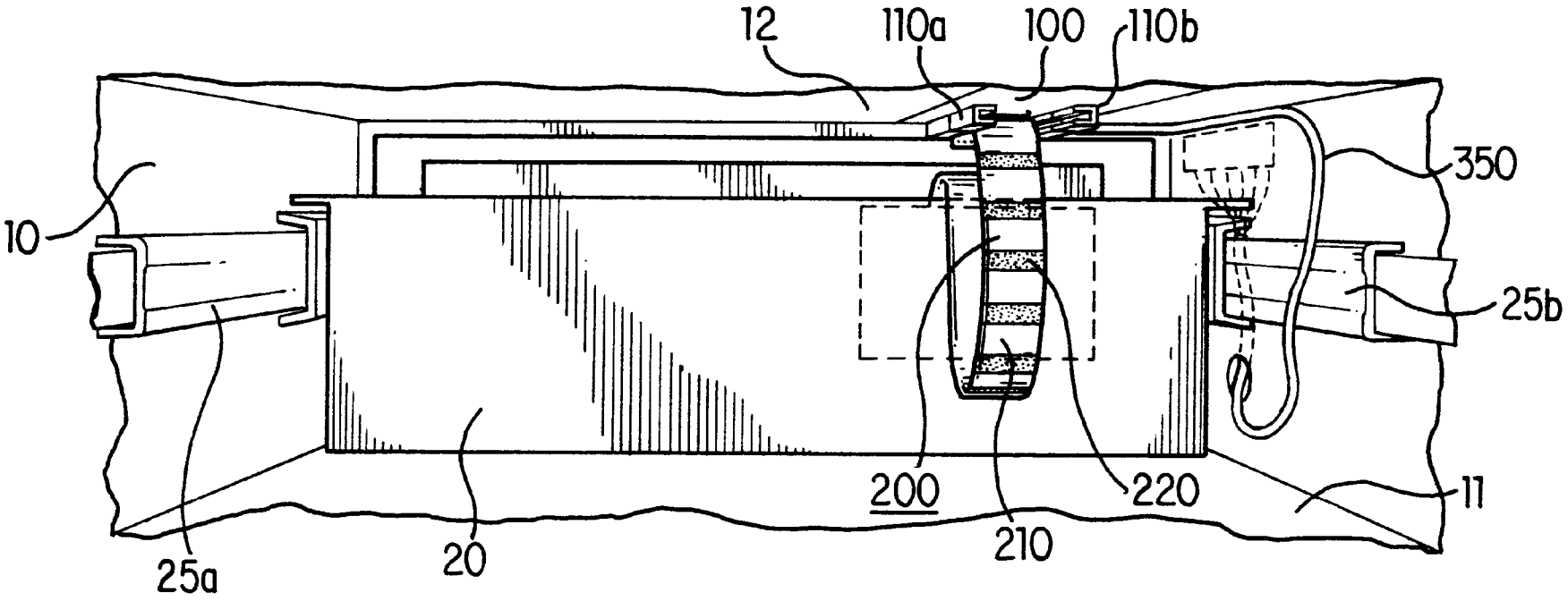
FIG. 2 is a different perspective view, partially cut-away, of the embodiment of the present invention as applied in FIG. 1.

Turning now to FIGS. 1–2, there is shown an embodiment of the subject covert actuation system 50 incorporated into a money drawer cabinet system typically employed, for instance, in banks and other institutions where regular monetary transactions occur as a matter of course. The cabinet system is typically formed by a frame assembly 10 which houses a plurality of drawer or other storage assemblies 20 within which currency, along with other loose articles, is stored. As security is often a significant concern in such applications, an electric connector mechanism 300 is secured to a portion of frame assembly 10 that would not be readily visible to a bystander. Through connector mechanism 300, a plurality of electric devices 30*a*–30*b* that operate within a surrounding security system may be coupled for automatic actuation or adjustment responsive to the occurrence of some triggering event within housing assembly 10 or drawer assembly 20. Such devices 30*a*–30*b* may include, depending on the particular application, video surveillance cameras, security alarms, entrance locks, sensory devices of various type, and the like. The particular considerations pertaining to such devices, like the particular choice of electric devices to be actuated, their interconnection, their number, their configuration, and their operation, however, are not important to the present invention.

Covert actuation system 50 includes in addition to electric connector mechanism 300 a substantially planar attachment member 100 formed of a magneto-attractive material which is secured on an inner surface of frame assembly 10; an actuation device 400 disposed within drawer assembly 20; and, an elongate conductor assembly 200 that electrically couples actuation device 400 to connector mechanism 300. Preferably, actuation device 400 is an electric switching device that toggles from one conduction state to another responsive to the occurrence of a triggering event. Covert actuation system 50 also includes a plurality of adherent devices 220 disposed in spaced manner along a flexible intermediate conductor portion 210 of conductor assembly 200.

In the embodiment shown, actuation device 400 is a bill trap device (described in greater detail in following paragraphs) that is 'set' by the placement of a paper currency bill therein and switched, or triggered, by the removal of the bill therefrom. The switching signal generated by actuation device 400 is passed by conductor assembly 200 to connector mechanism 300 for dissemination to respective ones of the given electric devices 30*a*–30*b* being actuated.

Conductor assembly 200 includes a flexible intermediate portion 210 which extends from drawer assembly 20 to a predetermined portion of frame assembly 10 for electrical coupling to connector mechanism 300, preferably via a multi-conductor interfacing cable 350. Conductor assembly 200 preferably includes one or more sections of a flexible multi-conductor ribbon cable of a suitable type known in the art. In the embodiment shown, conductor assembly 200 employs a pair of separable cable sections—a forward section 205 and an intermediate section 210—which are detachably connected at an interface bracket assembly 250. Bracket assembly 250 may include any suitable mechanism formed in accordance with techniques known in the art in such manner that sufficient bracing and interconnection of the ends of cable sections 205, 210 to insure a stable coupling. While its use or particular configuration are not essential to the present invention, bracket assembly 250 enables convenient replacement of either cable section 205, 210 without disturbing the other while effecting an operational coupling that is substantially immune to disturbances that arise from repeated displacement of drawer assembly 20 and/or contact with articles contained within drawer assembly 20.

So as not to compromise concealment of covert actuation system 50, the forward cable section 205 connected to actuation device 400 is preferably passed through an opening formed therebeneath in the floor panel 22 of drawer assembly 20, and extended across the bottom of that floor panel 22. It is, from there, passed back through another opening 24 formed in the floor panel 22 and into engagement with bracket assembly 250 for electrical coupling to intermediate cable section 210. Preferably, appropriate measures known in the art are taken to adhesively secure to the floor panel 22 that portion of forward cable section 205 passing therebeneath. Thus maintained in flush contact against drawer assembly 20, forward cable section 205 does not remain free to potentially catch on an adjacent portion of frame assembly 10, another drawer assembly 20, or any drawer assembly contents.

Intermediate cable section 210 extends from bracket assembly 250 to, preferably, an upper surface portion 12 overlying the internal frame assembly compartment 11 occupied by the given drawer assembly 20 when it is 'closed.' The free end portion of intermediate cable section 210 is secured by a suitable fastening mechanism of any type known in the art to the surface portion 12 overhead, preferably at a point adjacent the opening through which the given drawer assembly 20 is received in frame assembly 10. Preferably, intermediate cable section 210 is of a length sufficient to permit free displacement of drawer assembly 20 over its full displacement range relative to frame assembly 10, yet of a length that urges the cable section's substantially taut extension at least at one limit of the given drawer assembly's displacement.

Figure 3:
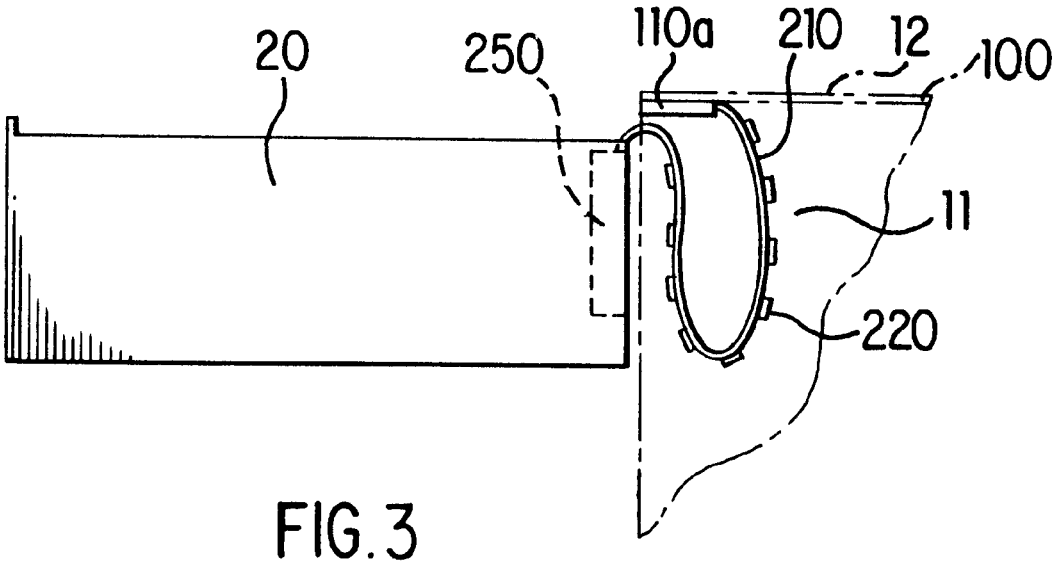
FIG. 3 is an elevation view, partially cut-away, illustrating the configuration of a portion of the embodiment of the present invention shown in FIG. 1 when a drawer assembly in the given application is placed in its fully open position.
Figure 4:
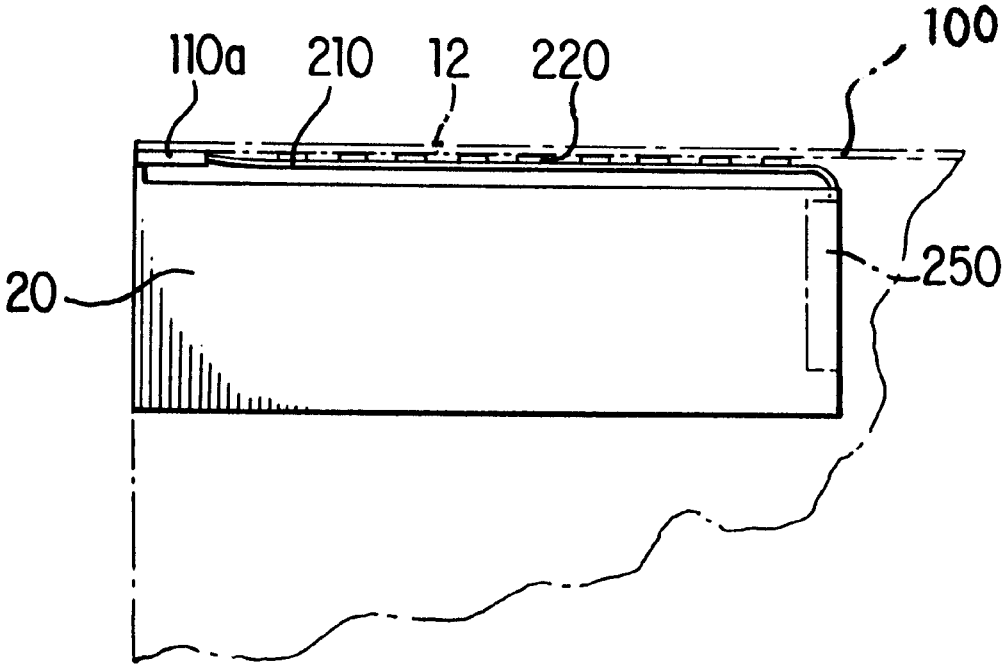
FIG. 4 is an elevation view, partially cut-away, illustrating the configuration of a portion of the embodiment of the present invention shown in FIG. 1 when a drawer assembly in the given application is shown in its fully closed position.

This is illustrated in FIGS. 3 and 4. With intermediate cable section 210 coupled between bracket assembly 250 and the fastening mechanism in the manner described, intermediate cable section 210 is allowed to flexibly collect within the vacated frame assembly compartment 11 when drawer assembly 20 is in its fully opened position. Intermediate cable section 210 is then extended across frame assembly surface portion 12, against attachment member 100, when drawer assembly 20 is returned to its fully closed position.

The flexibility of intermediate cable section 210 that affords the free, virtually unrestricted, displaceability of drawer assembly 20 relative to frame assembly 10 also renders intermediate cable section 210, and the electrical coupling it provides, vulnerable to disturbance from mechanical engagement with hardware components, articles, or debris in the immediately surrounding environment—disturbances to which more rigid conduction mechanisms may be substantially immune. Absent any restraining measure, intermediate cable section 210 could potentially catch on track hardware 25*a*, 25*b* by which a drawer assembly 20 is typically suspended; or, it may catch on contents of drawer assembly 20 that may have fallen out into the frame assembly compartment 11. In these and other cases, the engagement could very possibly cause a breakage of one or more conductors within intermediate cable section 210 or force at least a partial disconnection of its end portions from their respective electrical connections.

The possibility of such occurrences is significantly abated in accordance with the present invention by providing a plurality of adherent devices 220 in predetermined spaced manner along the length of intermediate cable section 210. Adherent devices 220 preferably include a plurality of permanent magnets of a suitable type known in the art secured to intermediate cable section 210. Adherent devices 220 are spaced sufficiently close together that, upon adhering to attachment member 100, they cooperatively maintain intermediate cable section 210 in substantially flush relation to that attachment member 100. This would occur when drawer assembly 20 is displaced to a particular position within its displacement range—preferably, its fully closed position (FIG. 4). Conversely, adherent devices 220 are disposed far enough apart that intermediate cable section 210 yet remains substantially flexible. This prevailing flexibility prevents intermediate cable section 210 from noticeably hindering the free displaceability of drawer assembly 20. The substantial flexibility, moreover, allows intermediate cable section 210 to be incrementally drawn away from engagement with attachment member 100 as drawer assembly 20 is displaced from its fully closed position toward its fully opened position.

Attachment member 100 to which adherent devices 220 adhere is preferably formed of a magneto-attractive metallic material such as steel or the like. It is preferably characterized by a substantially planar contour. Attachment member 100 need not be formed as a discrete member having to be affixed to an inner surface of frame assembly 10, but may be formed as a planar plate member integrally formed on that inner surface. Attachment member 100 may, in fact, simply be a portion of a panel formed of a sufficiently magneto-attractive material in the frame assembly itself.

It is preferable, though not necessary, that the fastening mechanism by which the terminal portion of intermediate cable section 210 is fastened to the frame assembly surface portion 12 include a substantially rigid card-like member to which are secured and electrically coupled together the terminal portion of intermediate cable section 210 and conductors leading from connector mechanism 300. It is preferable that the fastening mechanism also include a pair of slotted support rails 110*a*, 110*b* disposed in parallel on the surface of attachment member 100 for cooperatively supporting the card-like member when it is slid therebetween. Slotted support rails 110*a*, 110*b* are dimensioned and spaced apart in such manner that the card-like member is supported thereby in adjustable, yet frictionally engaged, manner. This allows for quick and convenient adjustment of the effective slack afforded by the given length of intermediate cable section 210. Such adjustment would be necessary, for instance, should drawer assembly 20 be replaced by another having a different depth dimension, or should the user simply prefer more or less slack in intermediate cable section 210. The user would simply slide the card-like member relative to support rails 110*a*, 110*b*, by the necessary distance in the appropriate direction, rather than replace the entire intermediate cable section 210.

During displacement of drawer assembly 20 relative to frame assembly 10, the substantially flat configuration of the ribbon cable employed for intermediate cable section 210 serves naturally to bias that intermediate cable section 210—if it is properly oriented—into alignment with the linear displacement direction of drawer assembly 20. To ensure such proper orientation, it is preferable that the point at which intermediate cable section 210 attaches to the card-like member of the fastening mechanism and the point at which it attaches to bracket assembly 250 be laterally aligned.

Figure 5:
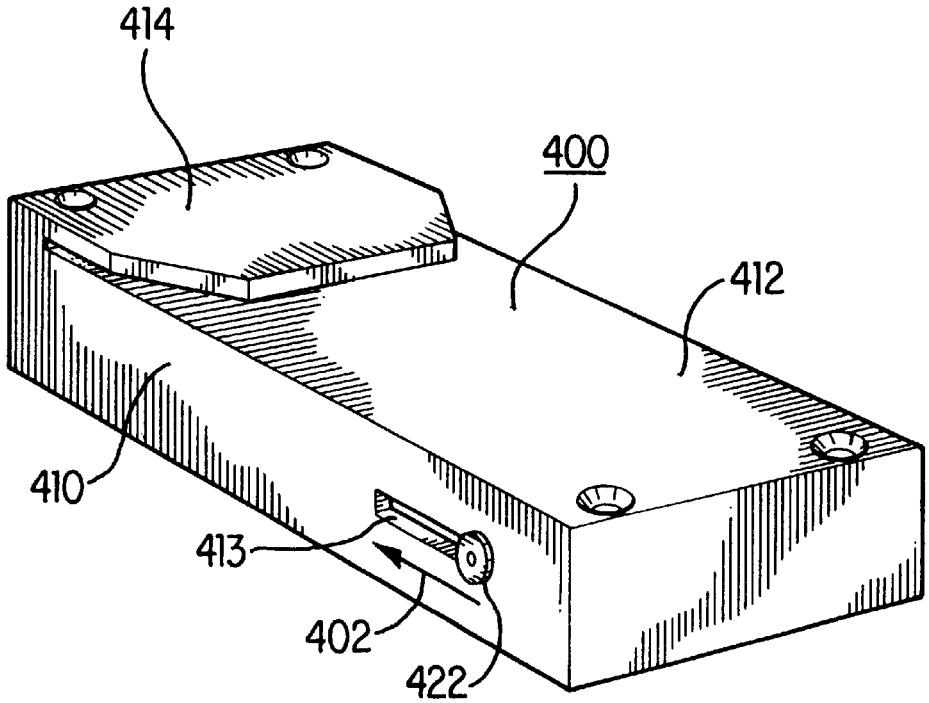
FIG. 5 is a perspective view of a preferred embodiment of an actuation device of the present invention in a triggered state.
Figure 6:
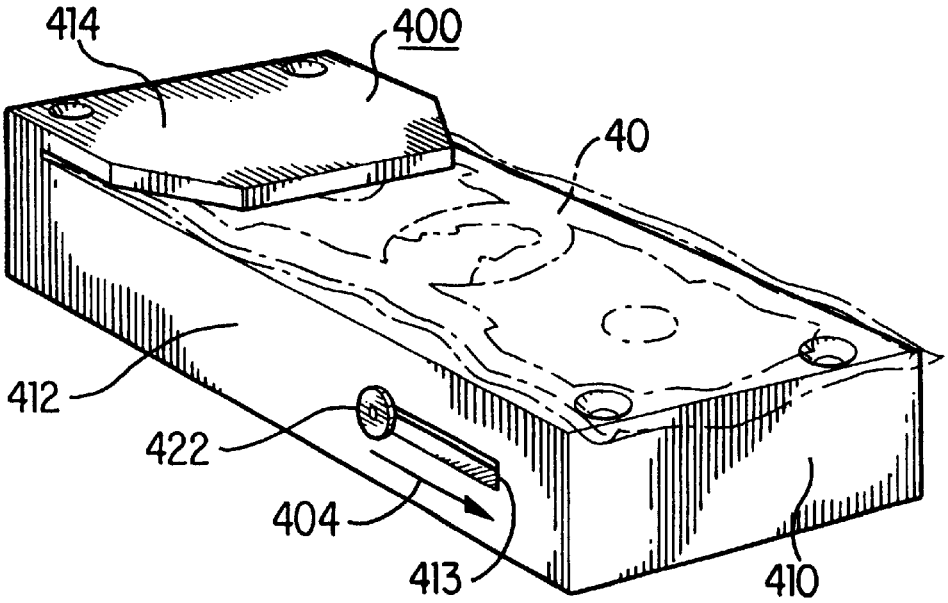
FIG. 6 is a perspective view of the embodiment of an actuation device of the present invention shown in FIG. 5 in a set state thereof.

Turning now to FIGS. 5–6, there is shown an embodiment of actuation device 400. Actuation device 400 is shown in the form of a bill trap alarm triggering device which is 'set' by the placement of a paper currency bill 40 therein and triggered by its removal therefrom.

In one embodiment, bill trap alarm triggering device 400 may be realized as an electromechanical device wherein a contact plate 420 (FIGS. 7, 8) member is displaceably disposed within a retaining block 410 having a base portion 412 and a clamping portion 414. Clamping portion 414 partially overhangs base portion 412 to define an insert space for a bill 40. Coupled to contact plate 420 is a pair of manipulation members 422 (only one is shown) accessible to a user through a corresponding slot 413 formed through base portion 412.

Bill trap alarm triggering device 400 may be set by sliding contact plate 420 via manipulation members 422 in the direction indicated by a directional arrow 402, then inserting a bill 40 between base portion 412 and clamping portion 414. Device 400 is thus configured for triggering, with contact plate 420 placed in its set position but biased toward displacement in the direction indicated by the directional arrow 404.

Figure 7:
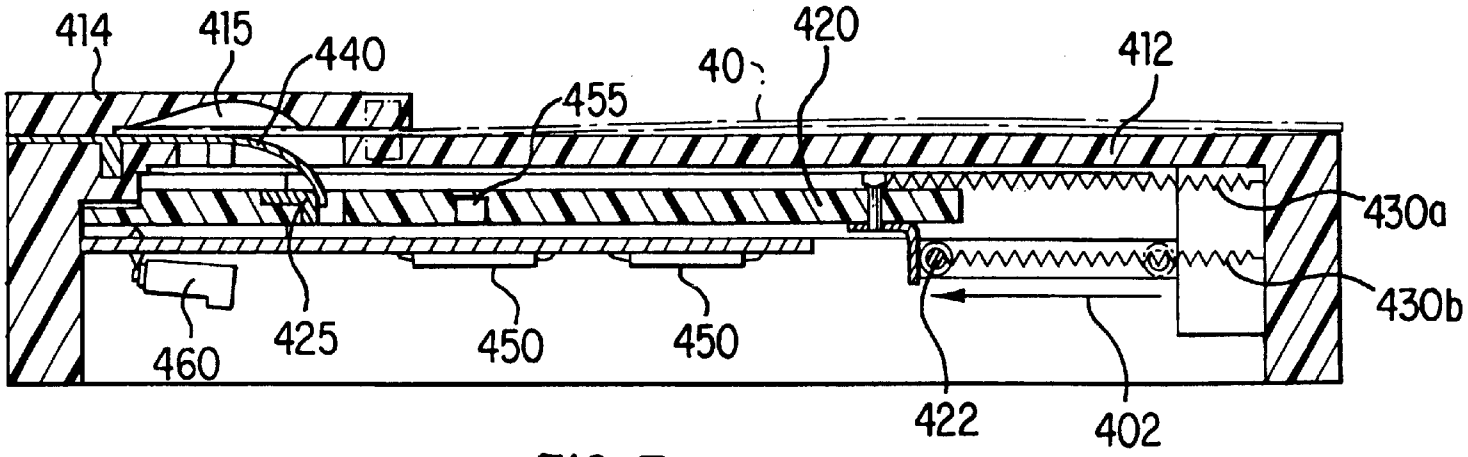
FIG. 7 is a cross-sectional elevational view of an embodiment of an actuation device of the present invention as shown in FIG. 6.
Figure 8:
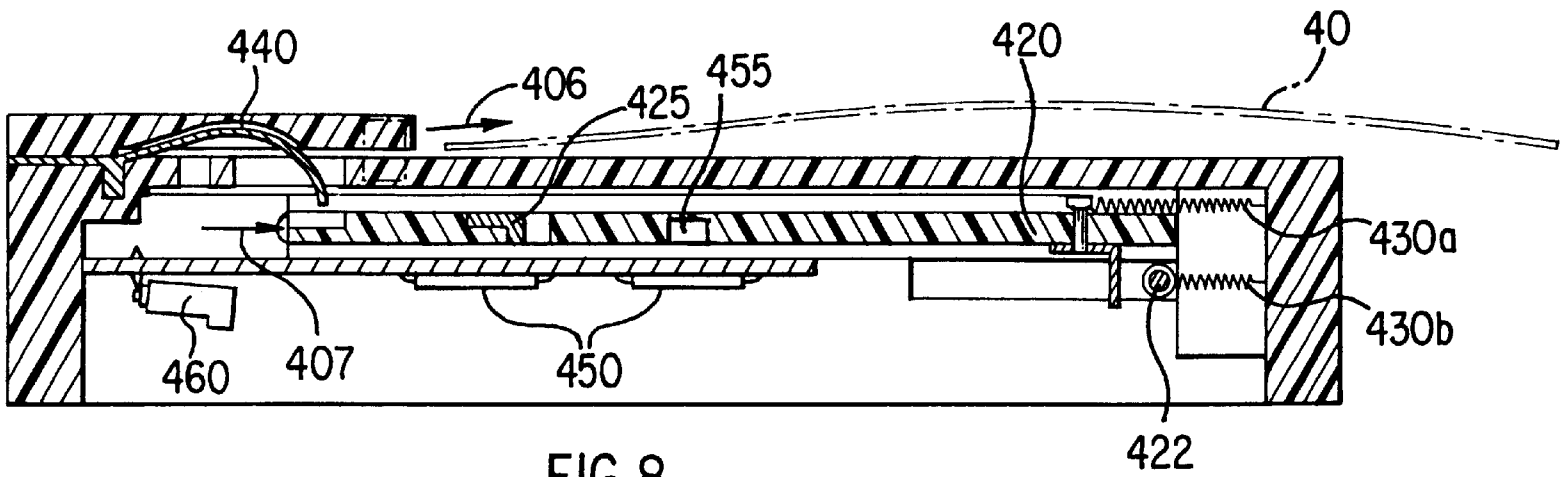
FIG. 8 is a cross-sectional elevational view of an embodiment of an actuation device of the present invention as shown in FIG. 5.

Referring now to FIGS. 7–8, there are shown cross-sectional views of the embodiment of actuation device 400 shown in FIGS. 5–6. Contact plate 420, in its set position (FIG. 7), is disposed such that a portion thereof opposes a substantial part of clamping portion 414. Contact plate 420 is biased towards its triggered position (FIG. 8) by a pair of biasing spring members 430*a*, 430*b* connecting it to base portion 412 of retaining block 410.

A clamping mechanism 440 is coupled to retaining block 410 and disposed adjacent clamping portion 414 below an accommodating recess 415 formed therein. Preferably, clamping mechanism 440 is a resilient leaf spring element formed of a metallic or other material of suitable strength, durability, and resilience. A terminal portion of clamping mechanism 440 is adapted to retentively engage an anchor member 425 formed in contact plate 420 when forced downward by the insert of a bill 40 in the space formed between clamping portion 414 and base portion 412, to thus releasably retain contact plate 420 in its set position. Upon removal of bill 40, as indicated by the directional arrow 406, clamping mechanism 440 returns to its unbiased configuration, withdrawing substantially into recess 415 of clamping portion 414. Clamping mechanism 440 thereby disengages from anchor member 425 of contact plate 420, releasing contact plate 420 for displacement by force of biasing spring members 430*a*, 430*b* in the direction indicated by the directional arrow 407.

A pair of switching devices—a pair of reed relays 450 in the embodiment shown—are disposed within retaining block 410 beneath contact plate 420. Each relay 450 is coupled to a connector 460 to which forward section 205 of conductor assembly 200 (not shown) is connected during operation. A magnetic member 455 is disposed within contact plate 420 at the appropriate position to enable it to directly oppose a preselected one of the reed relays 450 when contact plate 420 is in its set position, and to directly oppose the other reed relay 450 when contact plate 420 is in its triggered position. Depending on the position of magnetic member 455 relative thereto, the appropriate one of the reed relays 450 is rendered conductive.

Figure 9:
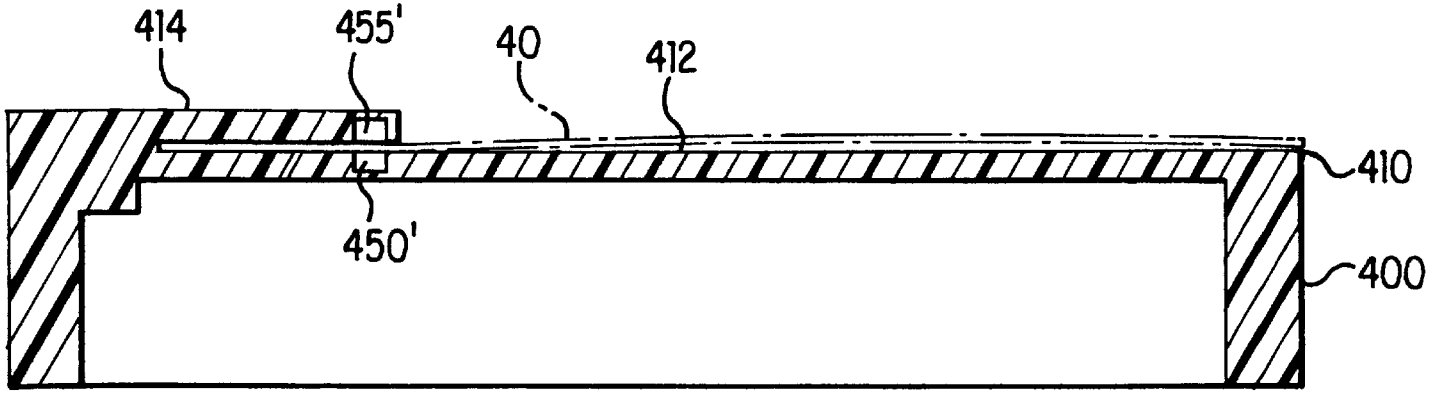
FIG. 9 is a cross-sectional elevational view of an alternate embodiment of an actuation device of the present invention in a set state; and, FIG. 10 is a cross-sectional elevational view of an alternate embodiment of an actuation device of the present invention in a triggered state.
Figure 10:
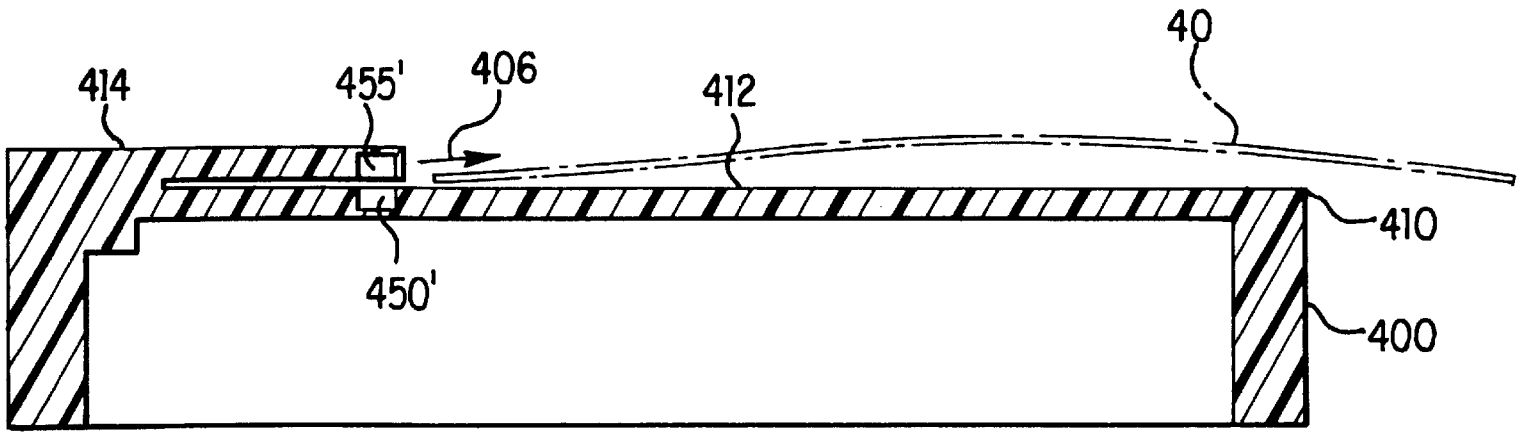

In an alternate embodiment, actuation device 400 may be realized as an electro-optically triggered device. In such alternate embodiment, the electromagnetic switching function cooperatively served by reed relays 450 and magnetic member 455 may be replaced by an electro-optic switching function served by a stationary electro-optic transmitter or receiver 450' disposed within base portion 412 of retaining block 410 and a corresponding receiver or transmitter 455' disposed in opposition thereto within clamping portion 414, as shown in FIGS. 9 and 10. A bill 40 inserted within the insert space between base portion 412 and clamping portion 414 would then break the optical beam that would otherwise pass between the transmitter and receiver devices 450'–455', until it is removed. Once bill 40 is removed, the optical beam would pass unhindered between devices 450' and 455', closing or breaking the appropriate circuits to connector 460.

As illustrated in FIGS. 9 and 10, when compared with corresponding FIGS. 7 and 8, the combination of moving components necessary for automatic triggering by use of reed relays 450 and magnetic member 455 are not essential if electro-optical devices 450', 455' are employed, and the overall structure of actuation device 400 may be simplified accordingly.

Although this invention has been described in connection with specific forms and embodiments thereof, it will be appreciated that various modifications other than those discussed above may be resorted to without departing from the spirit or scope of the invention. For example, functionally equivalent elements may be substituted for those specifically shown and described, proportional and absolute quantities of the elements shown and described may be varied, material compositions may be varied to the extent that functional properties are not substantially diminished, and relative arrangements of components may be varied, all without departing from the spirit or scope of the invention as defined in the appended claims.

What is claimed is:

1. A covert actuation system, adapted for incorporation within a housing structure having a storage assembly displaceably coupled to a frame assembly, for covertly actuating an electric device coupled to said housing structure comprising:

(a) an attachment member coupled to said frame assembly, said attachment member having a substantially planar attachment surface;

(b) electric connector means coupled to said frame assembly at a location displaced from said attachment member and adapted for the electric connection thereto of at least one said electric device;

(c) at least one actuation device coupled to said storage assembly, said actuation device being re-configurable between first and second operational states responsive to a predefined triggering event to selectively actuate said electric device;

(d) a conductor assembly coupled to said storage assembly and said frame assembly, said conductor assembly being electrically coupled to said actuation device and including a flexible intermediate section extending between said storage assembly in proximity to said attachment surface and said electric connector means;

(e) a plurality of adherent devices coupled to said conductor assembly in a predetermined spaced manner along said intermediate section thereof, said adherent devices being adapted to releasably adhere to said attachment surface;

whereby substantially all of said intermediate section is retained substantially against said attachment surface when said storage assembly is displaced to a first position relative to said frame assembly and is progressively drawn away from said attachment surface responsive to displacement of said storage assembly toward a second position relative to said frame assembly.

2. The system for covertly actuating an electronic device as recited in claim 1 wherein said adherent devices include a plurality of magnetic members.

3. The system for covertly actuating an electronic device as recited in claim 2 wherein said magnetic members are spaced one from the other in substantially equidistant manner along said intermediate section of said conductor assembly.

4. The system for covertly actuating an electronic device as recited in claim 3 wherein said conductor assembly includes a multi-conductor flat ribbon cable.

5. The system for covertly actuating an electronic device as recited in claim 1 wherein said actuation device includes a bill trap alarm triggering device.

6. The system for covertly actuating an electronic device as recited in claim 5 wherein said bill trap alarm triggering device is an electromechanical device including:

(a) a retaining block having a base portion and a clamping portion;

(b) a contact plate displaceably retained within said retaining block to be displaceable relative thereto between a first position and a second position, at least a portion of said contact plate, in said first position, opposing said clamping portion;

(c) bias means coupled to said retaining block and said contact plate for resiliently biasing said contact plate toward said second position;

(d) clamp means coupled to said retaining block adjacent said clamping portion, said clamp means being adapted to resiliently retain said contact plate in said first position responsive to engagement thereof by an article of predetermined configuration; and, (e) switching means coupled to at least one of said retaining block and said contact plate, said switching means being toggled responsive to said displacement of said contact plate between said first and second positions.

7. The system for covertly actuating an electronic device as recited in claim 6 wherein said switching means includes reed relay means.

8. The system for covertly actuating an electronic device as recited in claim 5 wherein said bill trap alarm triggering device is an electro-optical device.

9. The system for covertly actuating an electronic device as recited in claim 5 wherein said connector means of said frame assembly is adapted for the simultaneous electrical connection thereto of a plurality of electric devices including an alarm and a surveillance camera.

10. A system for covertly triggering an electronic security system comprising:

(a) a frame assembly having a substantially planar attachment surface defined therein, said frame assembly including electric connector means adapted for the electric connection of said security system thereto;

(b) at least one drawer assembly displaceably retained within said frame assembly, said drawer assembly being reversibly displaceable relative to said frame assembly along a displacement direction between an open position and a closed position;

(c) at least one actuation device coupled to said drawer assembly, said actuation device being reconfigurable between first and second operational states responsive to a predefined triggering event to selectively actuate said electric device;

(d) a conductor assembly coupled to said drawer assembly and said frame assembly, said conductor assembly being electrically coupled to said actuation device and including a flexible intermediate section connecting said drawer assembly and said electric connector means of said frame assembly, said intermediate section extending along a direction parallel to said displacement direction of said drawer assembly for reversible reconfiguration responsive to said displacement of said drawer assembly relative to said frame assembly;

(e) a plurality of magnetic members coupled to said conductor assembly in spaced manner along said intermediate section thereof, said magnetic members being adapted to releasably adhere to said attachment surface of said frame assembly;

whereby substantially all of said intermediate section is retained substantially against said attachment surface of said frame assembly when said drawer assembly is in one of said open and closed positions and is progressively drawn away therefrom responsive to said displacement of said drawer assembly toward the other of said open and closed positions.

11. The system for covertly triggering an electronic security system as recited in claim 10 wherein said conductor assembly includes a multi-conductor flat ribbon cable.

12. The system for covertly triggering an electronic security system as recited in claim 10 wherein said actuation device includes a bill trap alarm triggering device.

13. The system for covertly triggering an electronic security system as recited in claim 12 wherein said bill trap alarm triggering device is an electromechanical device including:

(a) a retaining block having a base portion and a clamping portion;

(b) a contact plate displaceably retained within said retaining block to be displaceable relative thereto between a first position and a second position, at least a portion of said contact plate, in said first position, opposing said clamping portion;

(c) bias means coupled to said retaining block and said contact plate for resiliently biasing said contact plate toward said second position;

(d) clamp means coupled to said retaining block adjacent said clamping portion, said clamp means being adapted to resiliently retain said contact plate in said first position responsive to engagement thereof by an article of predetermined configuration; and, (e) switching means coupled to at least one of said retaining block and said contact plate, said switching means being toggled responsive to said displacement of said contact plate between said first and second positions.

14. The system for covertly triggering an electronic security system as recited in claim 13 wherein said switching means includes reed relay means.

15. The system for covertly triggering an electronic security system as recited in claim 12 wherein said bill trap alarm triggering device is an electro-optical device.

16. The system for covertly triggering an electronic security system as recited in claim 12 wherein said connector means of said frame assembly is adapted for the simultaneous electrical connection thereto of a plurality of electric devices including an alarm and a surveillance camera.

17. A method of electrically coupling in concealed manner an electric device disposed outside a frame assembly to an automatic actuation device disposed within a drawer assembly displaceably retained within said frame assembly comprising the steps of:

(a) establishing connection means on said frame assembly for electrical connection thereto of at least one said electric device;

(b) establishing a conductor assembly electrically coupled to said actuation device and having a flexible intermediate section extending between said drawer assembly and said connection means;

(c) establishing a magneto-attractive attachment surface within said frame assembly;

(d) coupling to said intermediate section of said conductor assembly a plurality of magnetic members, said magnetic members being disposed in spaced manner along said intermediate section and being adapted to releasably attach to said attachment surface; and, (e) orienting said intermediate section of said conductor assembly to substantially align with the direction of displacement of said drawer assembly relative to said frame assembly, whereby said intermediate section of said conductor assembly is drawn against said attachment surface during a first portion of said drawer assembly displacement and drawn away from said attachment surface during a second portion of said drawer assembly displacement.

18. The method of electrically coupling as recited in claim 17 wherein said step of establishing said conductor assembly includes:

(a) coupling a multi-conductor flat ribbon cable between said actuation device within said drawer assembly and said connection means;

(b) passing said multi-conductor flat ribbon cable through a bottom panel of said drawer assembly; and, (c) affixing a first intermediate portion of said multi-conductor flat ribbon cable to said drawer assembly to extend therebeneath in substantially flush contacting manner, a second intermediate portion of said multi-conductor ribbon cable extending between said drawer assembly and said connection means.

19. The method of electrically coupling as recited in claim 18 wherein said step of establishing said attachment surface within said frame assembly includes locating said attachment surface to remain above at least a portion of said drawer assembly over the full range of said drawer assembly displacement.

20. The method of electrically coupling as recited in claim 19 wherein said second intermediate portion of said multi-ribbon cable extends responsive to displacement of said drawer assembly toward said frame assembly and bends responsive to displacement therof away from said frame assembly.

* * * * *